United States Patent [19]

Llinas

[11] Patent Number: 4,561,125

[45] Date of Patent: Dec. 31, 1985

[54] DRESS

[76] Inventor: Antonio M. Llinas, La Orotava (Tenerife), Spain

[21] Appl. No.: 598,415

[22] Filed: Apr. 9, 1984

Related U.S. Application Data

[63] Continuation of Ser. No. 352,843, Feb. 26, 1982, abandoned.

[30] Foreign Application Priority Data

Feb. 26, 1981 [ES] Spain ..... 256.489

[51] Int. Cl.[4] ..... A41D 1/22

[52] U.S. Cl. ..... 2/105

[58] Field of Search ..... 2/69, 69.5, 74, 76, 2/75, 105, 104, DIG. 7

[56] References Cited

U.S. PATENT DOCUMENTS

| | | | |
|---|---|---|---|
| 1,287,859 | 12/1918 | Bright | 2/76 |
| 1,432,249 | 10/1922 | Hoyme | 2/69 |
| 2,425,402 | 8/1947 | Sielott | 2/75 |
| 3,478,367 | 11/1969 | Vatti | 2/76 |
| 3,747,122 | 7/1973 | Goldberg | 2/69 |

FOREIGN PATENT DOCUMENTS

| | | | |
|---|---|---|---|
| 1280159 | 11/1961 | France | 2/69 |

*Primary Examiner*—Doris L. Troutman
*Attorney, Agent, or Firm*—Michael J. Striker

[57] ABSTRACT

A garment, particularly a female dress in comprised of only two pleated pieces of cloth which are joined to each other by side seams extended longitudinally of the dress such that they form armholes at the upper portion of the dress and by a shoulder seam which extends such as to form a neck aperture at the top of the dress. A lace extended around the neck aperture can be drawn to close the dress at the back thereof.

2 Claims, 1 Drawing Figure

DRESS

This is a continuation of application Ser. No. 352,843, filed Feb. 26, 1982, now abandoned.

BACKGROUND OF THE INVENTION

The present invention relates to garments and more particularly, to a female dress.

SUMMARY OF THE INVENTION

The advantages of the present invention reside in that the garment is made just of two pieces, and required only three seams (plus the hem edges) for the complete making of the dress, thereby the output costs become very low.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
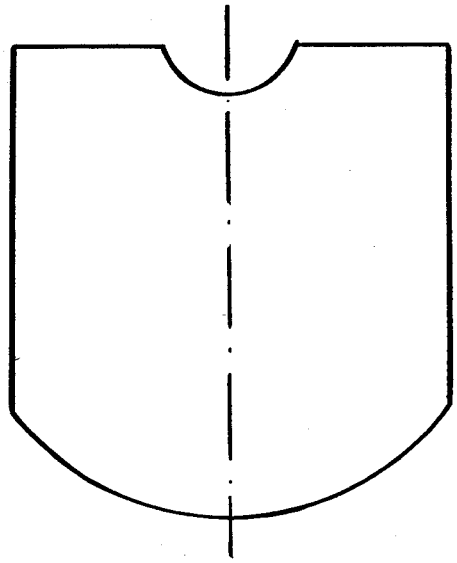
FIG. 1 is a front elevation of one of two pieces of cloth used to make a dress.

The dress is made of two cloth pieces entirely pleated and FIG. 1 shows one of two pieces of cloth used to make the dress, this one piece being unpleated.

Figure 2:
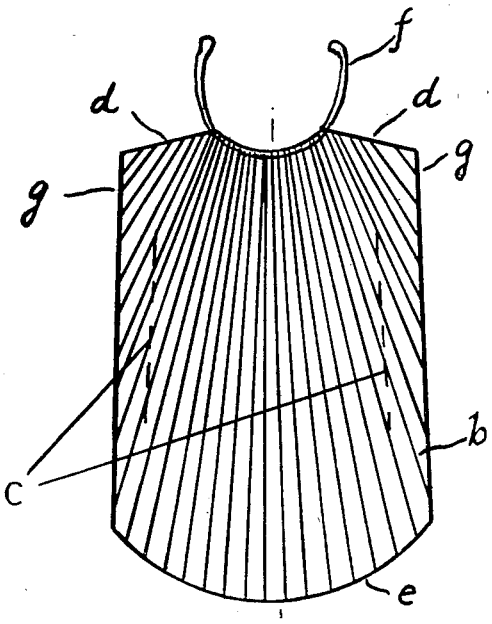
FIG. 2 is a front elevation of the complete dress.

During manufacture of the dress both pieces of cloth are pleated over substantially their entire respective areas as shown in FIG. 2. Pleats b are made such that they extend away from the arcuate neck aperture a.

To make the dress two identical pieces of cloth are joined to one another as mirrow images and attached to each other by seams c. The two side seams c are each spaced from the respective side edges of the garment as seen in FIG. 2. The two side seams c do not extend from the top of the garment to the bottom, but instead terminate some distance from the respective shoulder d to form armholes g and also terminate at a distance from the bottom edge e of the dress so that the portion of the dress below the lowest extent of the same c may flare slightly to form a skirt portion.

The seams c thus are not made on the respective edges of both pieces, but in the inside thereof letting some pleats to cause the sensation that the dress is quite open at the sides, although in fact it is not so. The pleat structure makes the dress to be fitted to any human body, then it is not required the making of different sizes. The closing of the dress is made by a lace wrapping the neck and being fastened at the back part of the dress and being able on account of the pleating be more or less clinged to the neck. The guide for the lace f is the third of the three mentioned seams, such seam closes also both shoulders d.

It will be understood that each of the elements described above, or two or more together, may also find a useful application in other types of garments differing from the types described above.

While the invention has been illustrated and described as embodied in a dress, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dress, comprising a body portion formed of only two pieces of cloth joined to each other adjacent respective side edges of the dress by side seams and by a shoulder joining seam at shoulder edges of the dress, said two pieces when joined together forming a neck aperture and a front portion and a back portion of the dress; and a lace wrapping said neck aperture and being fastenable at said back portion and forming the single fastening means on the dress, said front portion and said back portion being each pleated over the entire area thereof from said lace to a hem line and from one side edge to another side edge of the dress, whereby the dress is fitable to a human being of any size, said side seams terminating at a distance from the shoulder joining seam to form two armholes at two sides of the dress and being each also spaced from the respective side edge of the dress by such a distance to form at said armholes sleeves during the use of the dress.

2. The dress as defined in claim 1, wherein said shoulder joining seam forms around said neck aperture a guide accommodating said lace.

* * * * *